US005251976A

United States Patent [19]

Milstead

[11] Patent Number: 5,251,976

[45] Date of Patent: Oct. 12, 1993

[54] ASPHALT PLANT ADAPTED FOR THE BATCH PRODUCTION OF ASPHALT MIX CONTAINING RECYCLE ASPHALT PAVING

[75] Inventor: John Milstead, Chattanooga, Tenn.

[73] Assignee: Astec Industries, Inc., Chattanooga, Tenn.

[21] Appl. No.: 863,831

[22] Filed: Apr. 6, 1992

[51] Int. Cl.[5] ..... B28C 7/04

[52] U.S. Cl. ..... 366/18; 366/22; 366/33; 414/21; 414/299; 414/328

[58] Field of Search ..... 366/6-8, 366/14, 16, 17-19, 22-25, 27-28, 33-34, 40, 131, 134, 141, 177, 181, 189, 192; 414/21, 299, 300, 328, 329

[56] References Cited

U.S. PATENT DOCUMENTS

| | | | |
|---|---|---|---|
| 725,641 | 4/1903 | Ash | 366/18 |
| 1,791,109 | 2/1931 | Wittenberg | 366/7 |
| 2,190,044 | 2/1940 | Pollitz | 366/18 |
| 2,192,295 | 3/1940 | Kuhrts, Jr. | 366/6 |
| 2,285,765 | 6/1942 | Carswell | 414/21 X |
| 2,735,625 | 2/1956 | Preeman . | |
| 2,893,602 | 7/1959 | Barber et al. | 366/18 X |
| 3,068,076 | 12/1962 | Sackett, Sr. | 414/21 X |
| 3,091,369 | 5/1963 | Sackett, Sr. | 366/18 X |
| 3,129,779 | 4/1964 | Clements | 366/18 X |
| 3,170,677 | 2/1965 | Phister, Jr. et al. | 366/16 |
| 3,263,971 | 8/1966 | Farnham | 414/21 X |
| 3,314,557 | 4/1967 | Sackett, Sr. | 414/21 X |
| 3,482,824 | 12/1969 | Lehman et al. | 366/7 |
| 3,547,411 | 12/1970 | Sowell | 366/7 |
| 3,661,365 | 5/1972 | Cloud, Jr. | 366/18 |
| 3,741,532 | 6/1973 | Farnham et al. | 366/141 |
| 3,809,373 | 5/1974 | Brock | 366/18 |
| 3,856,275 | 12/1974 | Dydzyk | 366/27 |
| 3,866,887 | 2/1975 | Potter | 366/18 |
| 4,211,490 | 7/1980 | Brock et al. | 366/11 |
| 4,358,205 | 11/1982 | Eakins . | |
| 4,387,996 | 6/1983 | Mendenhall | 366/14 X |
| 4,579,458 | 4/1986 | Ohlson | 366/23 X |
| 4,638,747 | 1/1987 | Brock et al. | 366/25 X |
| 4,802,139 | 1/1989 | Sasaki | 366/16 |
| 4,867,572 | 9/1989 | Brock et al. | 366/40 X |
| 4,993,839 | 2/1991 | Brock | 366/7 |
| 5,052,810 | 10/1991 | Brock | 366/25 |

FOREIGN PATENT DOCUMENTS

| | | | |
|---|---|---|---|
| 1193202 | 11/1985 | U.S.S.R. | 366/18 |

*Primary Examiner*—Harvey C. Hornsby
*Assistant Examiner*—Charles Cooley
*Attorney, Agent, or Firm*—Niles & Nilles

[57] ABSTRACT

An asphalt production plant which is adapted to process mixtures of recycled paving and aggregate, and which comprises a rotary drum dryer for heating and drying stone aggregate, and an elevator for conveying the heated and dried aggregate to an elevated discharge location. A batch tower is positioned adjacent the elevator, and the batch tower comprises an aggregate sizing screen which receives and segregates the aggregate by size, and several underlying aggregate storage bins, with each aggregate bin receiving aggregate of predetermined average size from the sizing screen. Also, a recycle bin is positioned between and in alignment with the aggregate bins. A weigh hopper is provided for receiving the aggregate and/or recycle material from the bins, and a pugmill is positioned below the weigh hopper for mixing the material with hot liquid asphalt and then delivering the resulting mix into an underlying truck. A gate is provided for delivering the material from the elevator into either the sizing screen or the recycle bin. In addition, a weigh belt conveyor is provided for delivering the aggregate to the drum dryer at a predetermined feed rate by weight, and a weigh belt conveyor is provided for delivering the recycle material into the elevator at a predetermined feed rate by weight.

5 Claims, 2 Drawing Sheets

ASPHALT PLANT ADAPTED FOR THE BATCH PRODUCTION OF ASPHALT MIX CONTAINING RECYCLE ASPHALT PAVING

FIELD OF THE INVENTION

The present invention relates to an asphalt production plant for producing an asphaltic mix suitable for use in forming or resurfacing a roadway.

BACKGROUND OF THE INVENTION

Conventional batch type plants for producing asphaltic mix typically comprise a drum dryer for heating and drying the stone aggregate, and a vertical bucket elevator for conveying the heated and dried aggregate from the dryer to the top of a tower. The tower includes an enclosed vibrating screen section at the top, for receiving and segregating the aggregate by groups of average particle size. The segregated aggregate then drops through individual chutes to a bin section which underlies the screen section, and which comprises a plurality of separate bins, and so that each bin receives an aggregate of a predetermined average size from the screen section. Four such bins are typically provided, with the initial or "sand" bin having greater capacity than the remaining bins. A weigh hopper is positioned below the bins, which permits the aggregate from one or more bins to be weighed out to provide a desired mix, as required for example for a roadway base coat or a finish coat. A mixing pugmill is positioned below the weigh hopper for mixing the weighed quantity of aggregate with hot liquid asphalt, and the bottom of the pugmill includes a gate opening, such that the contents may be dropped into an underlying truck or other receptacle.

When making an asphaltic mix containing recycle asphalt paving (RAP), cold RAP is conventionally delivered from a feed bin and into the elevator at a controlled feed rate, and so as to be delivered to the screen section concurrently with the heated aggregate. The aggregate is preferably superheated, to a temperature of at least about 400° F., to permit it to dry and heat the RAP.

As will be apparent, once the decision is made to run RAP in the above described conventional plant, there is a fixed percentage of RAP in each bin, and all batches necessarily contain that percentage until the bins are emptied. Also, the percentage of RAP is limited to not more than about 20 percent, since a higher percentage tends to blind the screens of the screen section with sticky material.

In one early batch plant design, a separate bin for the cold RAP is positioned on the ground adjacent the tower, and a conveyor is provided for selectively delivering the cold RAP directly into the weigh hopper or into the pugmill mixer, where it comes into contact with superheated aggregate which is delivered from the storage bins. This results in a steam explosion, since the RAP typically has a high water content, and fumes and dust are blown into the atmosphere. Also, with this prior design, control of the composition of the final mix is limited, since the high temperature of the aggregate requires that RAP be included in each batch.

It is also known to add separate bins, which are filled by diverter chutes, to the side of a batch tower for special purposes. Some of these side bins are adapted to be filled with mixtures of virgin aggregate and RAP for blending with the aggregate contained in the other bins, but because of their position, these side bins often cannot supply all of the material for a batch. More particularly, these side bins load into one side of the weigh hopper, and the weigh hopper is thus unable to accept the desired volume of the mixture. Also, the side location of such bins renders it difficult to dispense RAP, since laterally directed side walls are required in order to direct the material laterally into the weigh hopper, and during discharge the RAP tends to stick to these side walls rather than flow smoothly from the bin.

It is accordingly an object of the present invention to provide an asphalt production plant which is adapted to process mixtures of aggregate, and/or aggregate and RAP, and which permits the formulation for each delivered batch to be readily varied, and which specifically permits formulations having a relatively high percentage of RAP in the mix of up to 30–40 percent.

It is a more particular object of the present invention to provide an asphalt batch plant which retains all of the versatility provided by a conventional multi bin tower, and which also has the further capability of providing mixes having a relatively high percentage of RAP with the segregated aggregates from any of the aggregate bins.

It is also an object of the present invention to provide an asphalt production plant which avoids the release of steam and other gases to the atmosphere.

It is a further object of the present invention to provide an asphalt production plant having a recycle bin which is positioned so as to permit a full charge of the recycle material to be freely delivered into the weigh hopper.

SUMMARY OF THE INVENTION

The above and other objects of the present invention are achieved in the preferred specific embodiment as illustrated herein by the provision of an asphalt production plant which comprises a rotary drum dryer for heating and drying stone aggregate, and an elevator for conveying the heated and dried aggregate from the rotary dryer upwardly to an elevated discharge location. A second material, such as recycled asphalt, is delivered into the elevator so that the second material is also conveyed to the discharge location, and a gate is provided for selectively directing the material conveyed to the discharge location either into a first duct or into a second duct. An upright tower is positioned adjacent the elevator means, and a plurality of aggregate bins are mounted in the upper portion of the tower and positioned in a laterally aligned relationship. A recycle bin is mounted in the upper portion of the tower adjacent the aggregate bins and is connected to the first duct. An aggregate screening section is mounted to the tower above the aggregate bins for receiving aggregate delivered through the second duct and for separating the aggregate into groups of varying average size and delivering the separated groups into respective ones of the aggregate bins. Further, a weigh hopper is mounted in the tower below the aggregate bins and the recycle bin for weighing out a selected amount of the material from each of the aggregate bins and the recycle bin, and a pugmill mixing apparatus is mounted in the tower below the weigh hopper for selectively receiving material from the weigh hopper and mixing the same with a predetermined amount of liquid asphalt, and for delivering the resulting asphalt mix into an underlying receiver.

In the preferred embodiment, the recycle bin is positioned between the aggregate bins. This central location of the recycle bin permits a full charge of the material from the recycle bin to be delivered into the weigh hopper, since the material is delivered into the central portion of the weigh hopper which permits the weigh hopper to accept the greatest volume. The central location also facilitates delivery of the material from the recycle bin since the centrally located recycle bin can have steeper side walls which permits the relatively sticky recycle material to readily flow.

BRIEF DESCRIPTION OF THE DRAWINGS

Some of the objects and advantages of the present invention having been stated, others will appear as the description proceeds when taken in conjunction with the accompanying drawings, in which.

DETAILED DESCRIPTION OF THE PREFERRED EMBODIMENT

Figure 1:
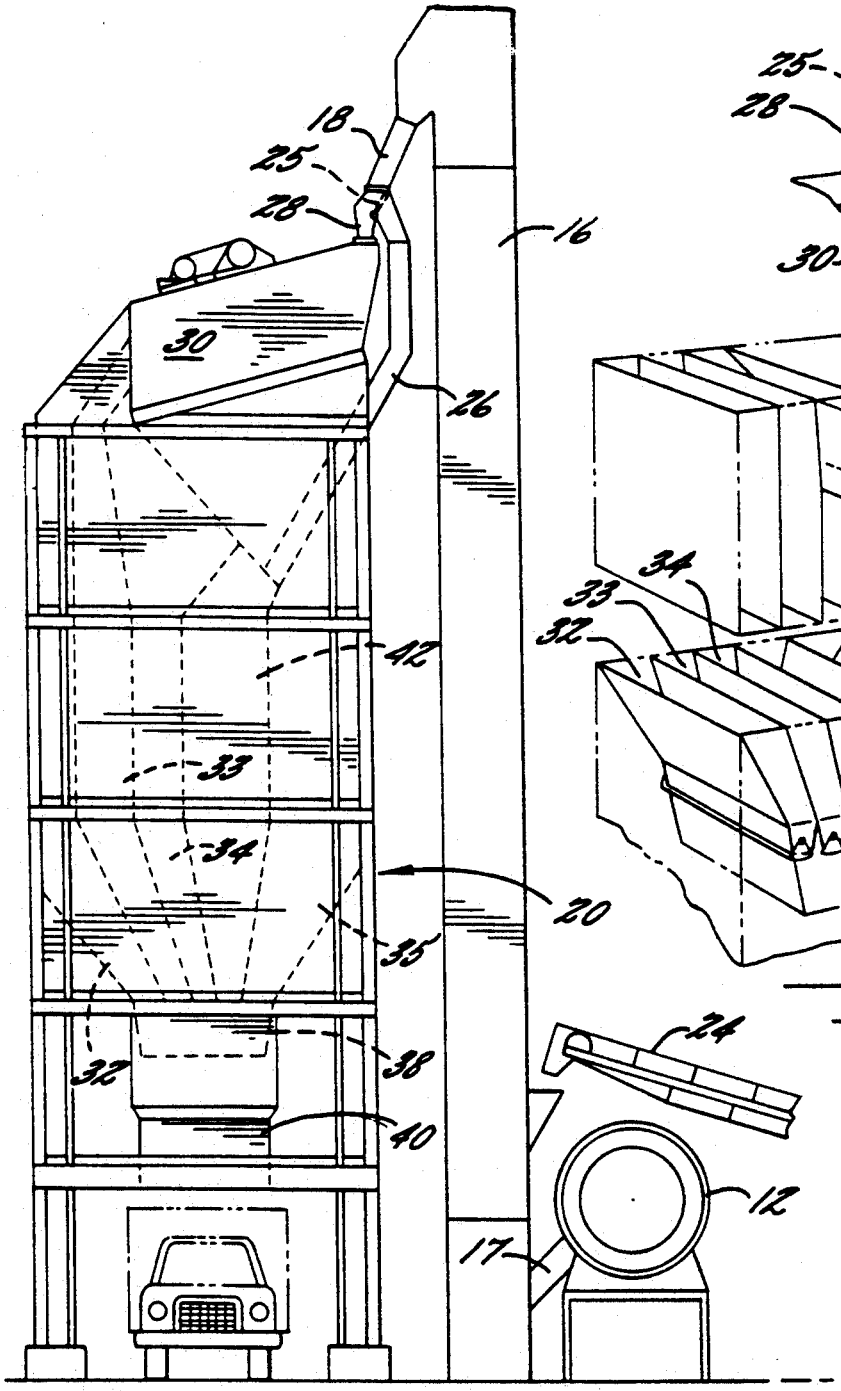
FIG. 1 is a fragmentary side elevation view of an asphalt production plant which embodies the features of the present invention.
Figure 3:
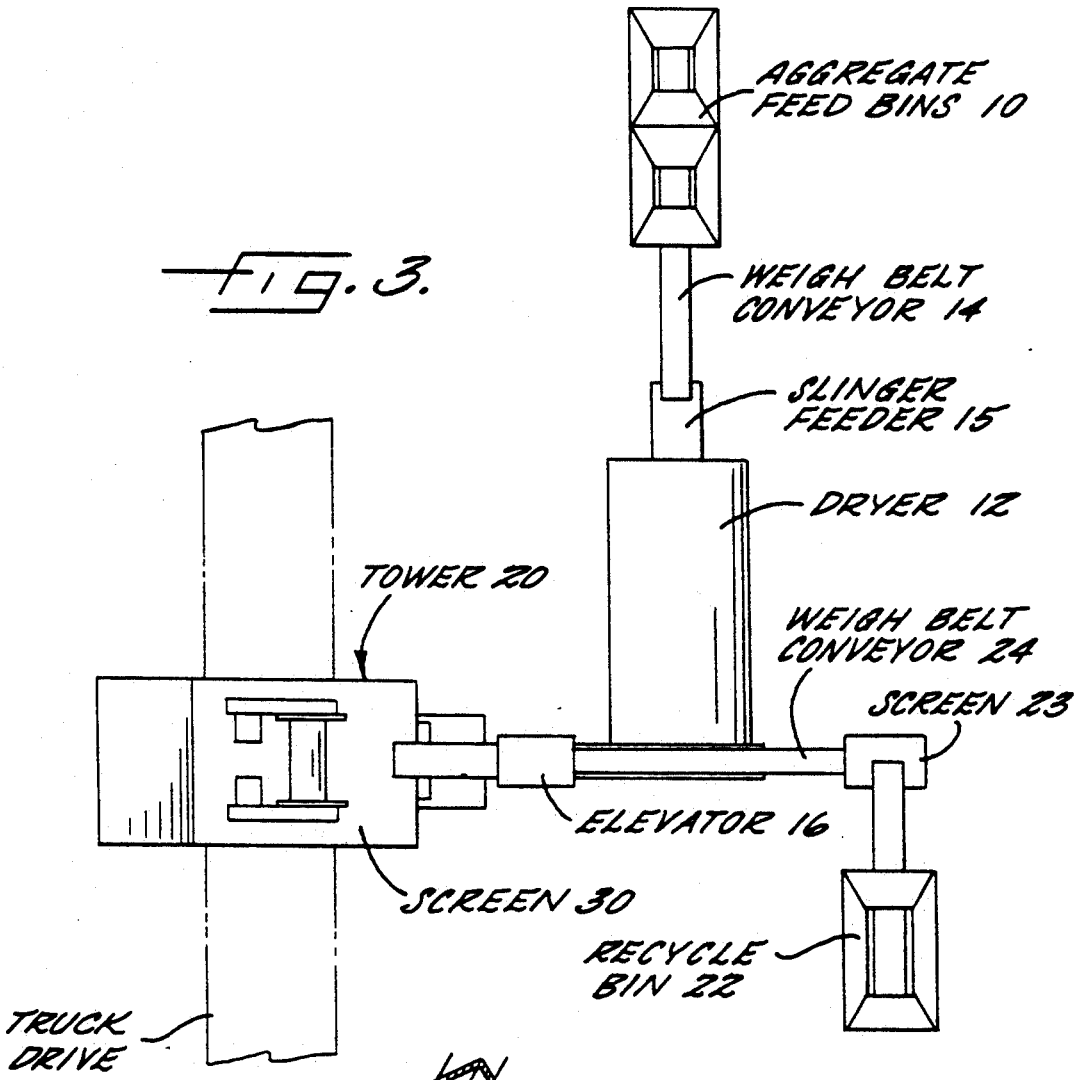
FIG. 3 is a top plan view of the asphalt production plant shown in FIG. 1 on a somewhat reduced scale.

Referring more particularly to the drawings, FIGS. 1 and 3 schematically illustrate a preferred embodiment of an asphalt production plant in accordance with the present invention. The plant includes a plurality of aggregate feed bins 10 (FIG. 3) for storing stone aggregate, and a drum dryer 12 which is provided for heating and drying the aggregate. The aggregate is delivered from the bins 10 into the dryer via a conveyor 14 having a conventional weigh belt section so as to deliver the aggregate at a predetermined feed rate by weight. A conventional slinger feeder 15 receives the weighed aggregate and delivers it into the dryer 12.

The drum dryer 12 is preferably of a conventional counterflow design such as illustrated in U.S. Pat. Nos. 4,867,572 and 5,052,810, but alternatively, it may comprise a conventional parallel flow dryer of the type illustrated in U.S. Pat. Nos. 4,638,747 and 4,211,490. The dryer 12 delivers the heated and dried aggregate to a conventional bucket type enclosed elevator 16 via a discharge chute 17, and the elevator conveys the aggregate upwardly to a discharge outlet chute 18 located above a batch tower 20.

A feeding system is also provided for delivering recycled asphalt pavement (RAP) into the bucket elevator 16. As illustrated, the RAP feeding system includes a feed bin 22 which delivers the RAP through a screen 23 and then to a conveyor 24 having a conventional weigh belt section. The conveyor 24 delivers the RAP to the elevator 16 above the entry location for the heated aggregate from the dryer. Alternatively, the RAP conveyor 24 could deliver the RAP directly into the outlet of the dryer 12. The weigh belt section in the conveyor 24 permits the RAP to be delivered at a predetermined feed rate by weight. Thus the RAP and the heated aggregate can be continuously blended in predetermined proportions.

A gate 25 is mounted in the discharge chute 18 for selectively directing the aggregate and/or RAP discharged through the discharge chute into either a first duct 26 or a second duct 28.

The batch tower 20 is positioned adjacent the bucket elevator 16, and the batch tower comprises an aggregate sizing screen 30 mounted at the top of the tower for receiving the aggregate from the second duct 28, and as is conventional, the screen 30 is adapted to segregate the aggregate by average particle size so as to obtain a plurality of groups of different average particle size. Also, a plurality of separate and heat insulated aggregate storage bins 32–35 are laterally aligned below the screen 30, such that the segregated groups of aggregate are delivered into respective ones of the bins 32–35. The screen may also incorporate a reject chute (not shown) for discharging oversize particles.

Figure 2:
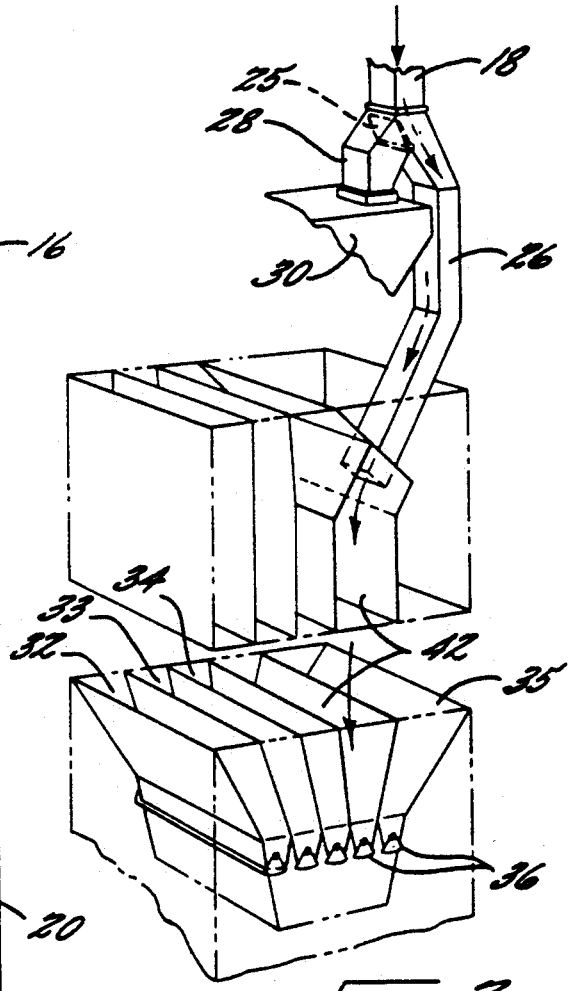
FIG. 2 is a fragmentary perspective view of the upper portion of the tower of the present invention.

A clam shell gate 36 (FIG. 2) is positioned at the bottom end of each bin 32–35, and a weigh hopper 38 is positioned below the bins for weighing out predetermined amounts of the aggregate from each of the aggregate bins. The lower portion of the weigh hopper includes a discharge gate (not shown), which permits its weighed contents to be discharged into an underlying pugmill 40. The pugmill 40 is preferably of a conventional twin shaft design and it mixes the weighed out aggregate with a weighed quantity of hot liquid asphalt which is delivered from an asphalt weigh bucket or spray system (not shown). The bottom of the pugmill 40 includes a discharge gate (not shown) through which the mixed product may be dropped directly into an underlying truck or other receiver.

The above described components of the batch tower 20 are conventional, and a tower of this construction is presently sold by Astec Industries, Inc. of Chattanooga, Tenn. Also, components of the described tower are further illustrated in U.S. Pat. Nos. 4,993,839 and 4,387,996.

Figure 4:
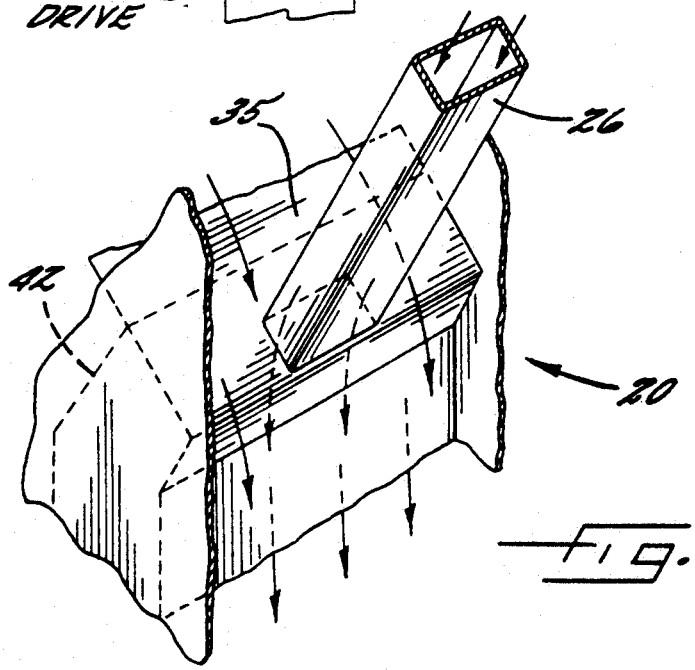
FIG. 4 is a fragmentary perspective view of the upper portion of the recycle bin and the delivery chute of the present invention.

In accordance with the present invention, a bin 42 is positioned in the upper portion of the tower and so as to be positioned centrally within the tower 20 and between the aggregate bins 34 and 35 as seen in FIG. 1. The bin 42 is adapted for storing the RAP, and is accordingly referred to herein as the recycle bin. The recycle bin 42 is connected to the first duct 26 as best seen in FIG. 4, so that any material passing into the first duct 26 is delivered into the recycle bin. The recycle bin 42 also includes a clam shell gate 36 at its bottom, so that upon opening of the gate any material in the recycle bin is delivered into the central portion of the weigh hopper 38.

The plant as described above can be operated under a variety of operating conditions so as to permit a high degree of variation in the composition of the delivered mix. In one mode, the heated aggregate and cold RAP are fed into the bucket elevator 16 at feed rates which are separately controllable by the weigh belt conveyors 14 and 24 to provide a predetermined composition, which can range up to about 30–40 percent RAP. Higher percentages of RAP are not normally employed, since the RAP is preferably heated by the aggregate, although such higher percentages may be possible in certain applications. The RAP-aggregate mix is delivered through the first duct to the recycle bin 42, where it is stored. It is also possible, however, to deliver the RAP-aggregate mix through the second duct to the screening section, where the percentage of RAP is relatively low.

The fact that the cold RAP and the heated aggregate are mixed prior to its delivery into the bin is advantageous, since the RAP is thereby heated and able to release its water vapor on a continuous basis during its residence time in the storage bin. The released water vapor can be readily controlled by a conventional plant scavenger system. Also, this release of the water vapor avoids a steam explosion when the RAP is mixed with the heated aggregate in the weigh hopper or pugmill. Also, when aggregate and RAP are being blended in the described manner, it is preferred that the temperature of the aggregate be superheated as compared to the temperature of the aggregate delivered to the bins 32–35, since the extra heat energy is useful in raising the temperature of the RAP to the desired level.

The invention permits a batch to be efficiently made entirely from the contents of the recycle bin, since it is located where it can fully load the weigh bucket. The blending of any percentage of material from the recycle bin with the aggregate from the aggregate bins is also possible, so as to expand the range of mixes available for supply to small customers. The invention also permits the use of relatively high percentages of RAP without significant air pollution, since the risk of a steam explosion is effectively avoided.

In the drawings and specification, there has been set forth a preferred embodiment of the invention, and although specific terms are employed, they are used in a generic and descriptive sense only and not for purposes of limitation.

That which is claimed is:

1. An asphalt production plant comprising a rotary drum dryer for heating and drying stone aggregate, elevator means for conveying the heated and dried aggregate from said rotary dryer upwardly to an elevated discharge chute, means for delivering a second material into said elevator means so that the second material is also conveyed to said discharge chute, gate means communicating with said discharge chute for selectively directing material conveyed to said discharge chute either into a first duct or into a second duct, an upright tower positioned adjacent said elevator means, a plurality of aggregate bins mounted in the upper portion of said tower and positioned in a laterally aligned relationship, a recycle bin mounted in the upper portion of said tower so as to be laterally aligned with said aggregate bins and intermediate selected ones of said aggregate bins, aggregate screen means mounted to said tower above said aggregate bins for receiving aggregate delivered through said second duct and for separating the aggregate into groups of varying average size and delivering the separated groups into respective ones of said aggregate bins, said first duct communicating directly with an upper portion of said recycle bin and delivering the second material to the recycle bin without passing through said screening means, weigh hopper means mounted in sad tower below said aggregate bins and said recycle bin for weighing out a selected amount of the material from each of said aggregate bins and said recycle bin, and mixing means mounted in said tower below said weigh hopper means for selectively receiving material from said weigh hopper means and mixing the same with a predetermined amount of liquid asphalt, and for delivering the resulting asphalt mix into an underlying receiver.

2. The asphalt production plant as defined in claim 1 further comprising means for delivering said aggregate to said drum dryer at a predetermined feed rate by weight, and said means for delivering a second material includes means for delivering the second material at a predetermined feed rate by weight.

3. The asphalt production plant as defined in claim 1 wherein said first duct extends laterally through at lest one of said aggregate bins.

4. An asphalt production plant comprising a rotary drum dryer for heating and drying stone aggregate, elevator means for conveying the heated and dried aggregate from said rotary dryer upwardly to an elevated discharge chute, an upright tower positioned adjacent said elevator means, a plurality of aggregate bins mounted in the upper portion of said tower and positioned in a laterally aligned relationship, a recycle bin mounted in the upper portion of said tower so as to be laterally aligned with said aggregate bins and intermediate selected ones of said aggregate bins, aggregate screening means mounted to said tower above said aggregate bins for receiving aggregate delivered to said discharge chute and for separating the aggregate into groups of varying average size and delivering the separated groups into respective ones of said aggregate bins, means including a duct which is in communication with said discharge chute and which extends laterally through at least one of said aggregate bins and communicates with an upper portion of said recycle bin for delivering a second material into said recycle bin without passing through said screening means, weigh hopper means mounted in said tower below said aggregate bins and said recycle bin for weighing out a selected amount of material from each of said aggregate bins and said recycle bin, and mixing means mounted in said tower below said weigh hopper means for selectively receiving materials from said weight hopper means and mixing the same with a predetermined amount of liquid asphalt, and for delivering the resulting asphalt mix into an underlying receiver.

5. The asphalt production plant as defined in claim 4 further comprising means for delivering said aggregate to said drum dryer at a predetermined feed rate by weight, and said means for delivering a second material includes means for delivering the second material at a predetermined feed rate by weight.

* * * * *